US012258779B1

(12) United States Patent
Tomasello

(10) Patent No.: US 12,258,779 B1
(45) Date of Patent: Mar. 25, 2025

(54) POOL DRAIN COVER

(71) Applicant: John Tomasello, Germantown, MD (US)

(72) Inventor: John Tomasello, Germantown, MD (US)

( * ) Notice: Subject to any disclaimer, the term of this patent is extended or adjusted under 35 U.S.C. 154(b) by 220 days.

(21) Appl. No.: 18/089,121

(22) Filed: Dec. 27, 2022

(51) Int. Cl.
*E04H 4/14* (2006.01)
*E04H 4/12* (2006.01)

(52) U.S. Cl.
CPC ..... *E04H 4/14* (2013.01); *E04H 4/1236* (2013.01)

(58) Field of Classification Search
CPC ..... B63B 43/16; E03C 1/264
See application file for complete search history.

(56) References Cited

U.S. PATENT DOCUMENTS 5,390,377 A * 2/1995 Blough ..... E04H 4/065 4/573.1
5,685,252 A * 11/1997 Prysner ..... B63B 43/16 114/229
6,574,804 B1 * 6/2003 Boujon ..... E04H 4/065 4/504
6,615,417 B1 9/2003 Newhard
6,817,043 B2 11/2004 Zars
D890,889 S * 7/2020 Liu ..... D23/261
11,624,197 B1 * 4/2023 Mc Gill ..... E04H 4/065 4/495
2002/0078496 A1 * 6/2002 Mullings ..... E04H 4/1236 4/507
2003/0019025 A1 * 1/2003 Mullings ..... E04H 4/1236 4/507
2003/0140569 A1 * 7/2003 Glynos ..... A01F 25/13 52/4
2005/0199538 A1 * 9/2005 Knapp ..... E04H 4/14 210/167.2
2014/0053330 A1 * 2/2014 Butera ..... E04H 4/14 4/496
2020/0080291 A1 * 3/2020 Hsu ..... E03C 1/264
2023/0279682 A1 * 9/2023 Roberts ..... B66D 1/7447 4/495
2024/0052617 A1 * 2/2024 Leavitt ..... E03C 1/2302

* cited by examiner

*Primary Examiner* — Patrick J Maestri
(74) *Attorney, Agent, or Firm* — Sanchelima & Associates, P.A.; Jesus Sanchelima; Christian Sanchelima

(57) ABSTRACT

A pool drain cover including a cover assembly and a wires assembly. The cover assembly includes a cover and a bump, wherein the bump is a bubble-shaped portion integrally formed on the cover. The cover is placed over the pool drain cover to prevent collecting worms into the main drain pool system, thereby the cover may sink into the water and be positioned by means of a rope and a plurality of ropes included in the wires assembly. The user may handle the rope until reaching a predetermined position over the pool drain cover and pulling the rope to remove the cover from the pool drain cover when the user may consider appropriate.

10 Claims, 3 Drawing Sheets

POOL DRAIN COVER

1. FIELD OF THE INVENTION

The present invention relates to a drain cover and, more particularly, to a pool drain cover that is placed over the pool main drain to prevent worms from collecting into the drain system.

2. DESCRIPTION OF THE RELATED ART

Several designs for pool drain covers have been designed in the past. None of them, however, include a cover that matches with the flat surface of the bottom side of a pool, wherein the pool drain cover includes a bubble-shaped that conforms with the curved shape of the main pool drain which by means of wires is placed over said main pool drain.

Applicant believes that a related reference corresponds to U.S. Pat. No. 6,615,417 issued for anti-entrapment swimming pool and wading pool main drain cover and method. Applicant believes that another related reference corresponds to U.S. Pat. No. 6,817,043 issued for safety swimming pool replacement drain cover apparatus and method. None of these references, however, teach of a domed center integrally formed in a large flat sheet of plastic material.

Other documents describing the closest subject matter provide for a number of more or less complicated features that fail to solve the problem in an efficient and economical way. None of these patents suggest the novel features of the present invention.

III. SUMMARY OF THE INVENTION

It is one of the objects of the present invention to provide a device that enhances protection over the pool main drain cover against worms.

It is another object of this invention to provide a device that is easy to mount over the pool main drain and easy to remove.

It is still another object of the present invention to provide a device that will save money and time by eliminating the need of spending money on chemical cleaners.

It is yet another object of this invention to provide such a device that is inexpensive to implement and maintain while retaining its effectiveness.

Further objects of the invention will be brought out in the following part of the specification, wherein detailed description is for the purpose of fully disclosing the invention without placing limitations thereon.

IV. BRIEF DESCRIPTION OF THE DRAWINGS

Figure 1:
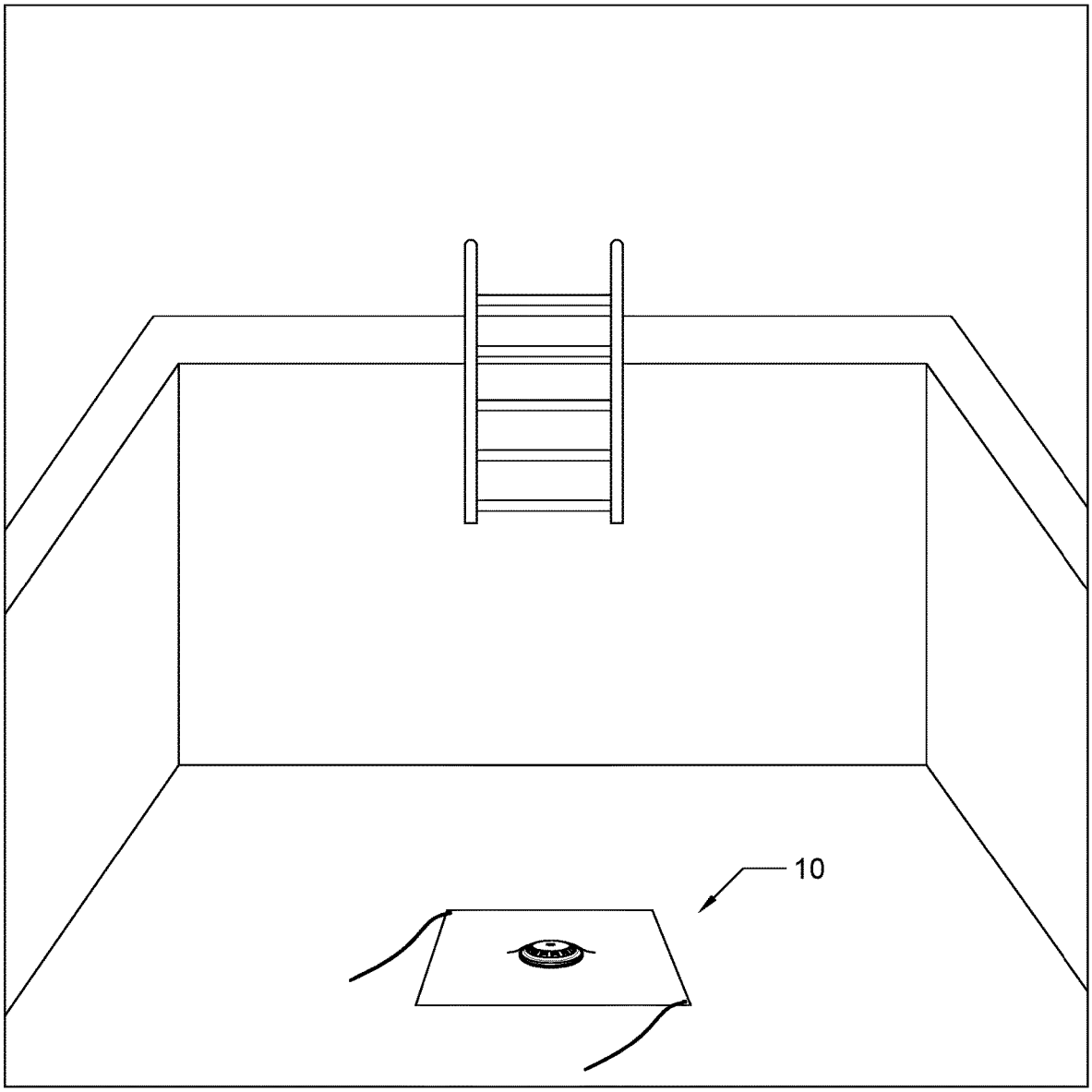

With the above and other related objects in view, the invention consists in the details of construction and combination of parts as will be more fully understood from the following description, when read in conjunction with the accompanying drawings in which:

FIG. 1 represents an operational view of an exemplary embodiment of the present invention 10.

Figure 2:
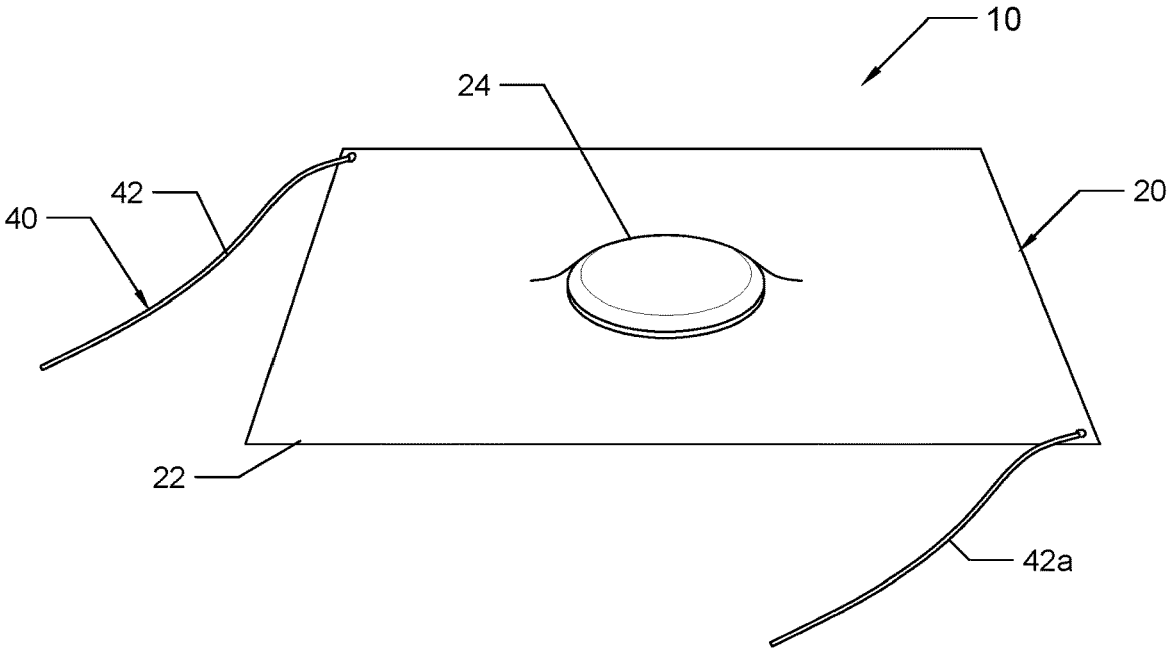

FIG. 2 shows an isometric view of the cover assembly 20, wherein the bump 24 is a protuberance on a level surface of the cover 22.

Figure 3:
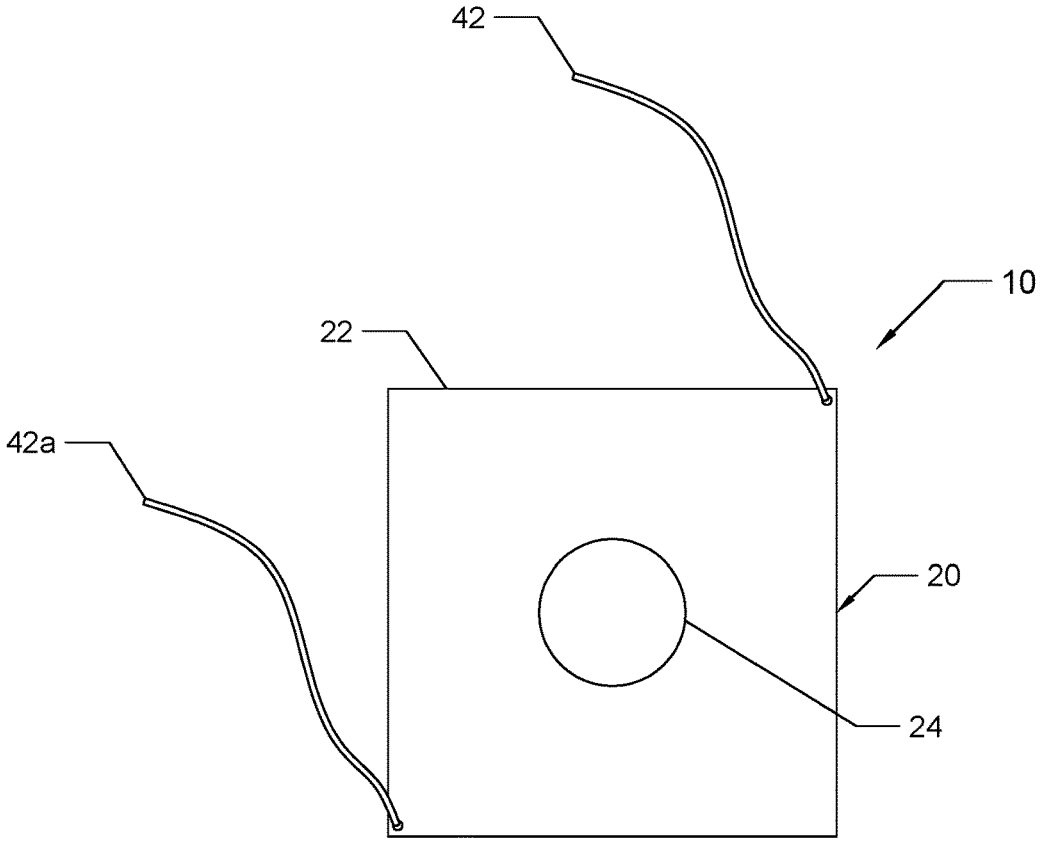

FIG. 3 illustrates a top view of the present invention 10, wherein the bump 24 has a circular shape and the wire assembly 40 is attached to at least one of the corners of the cover 22.

Figure 4:
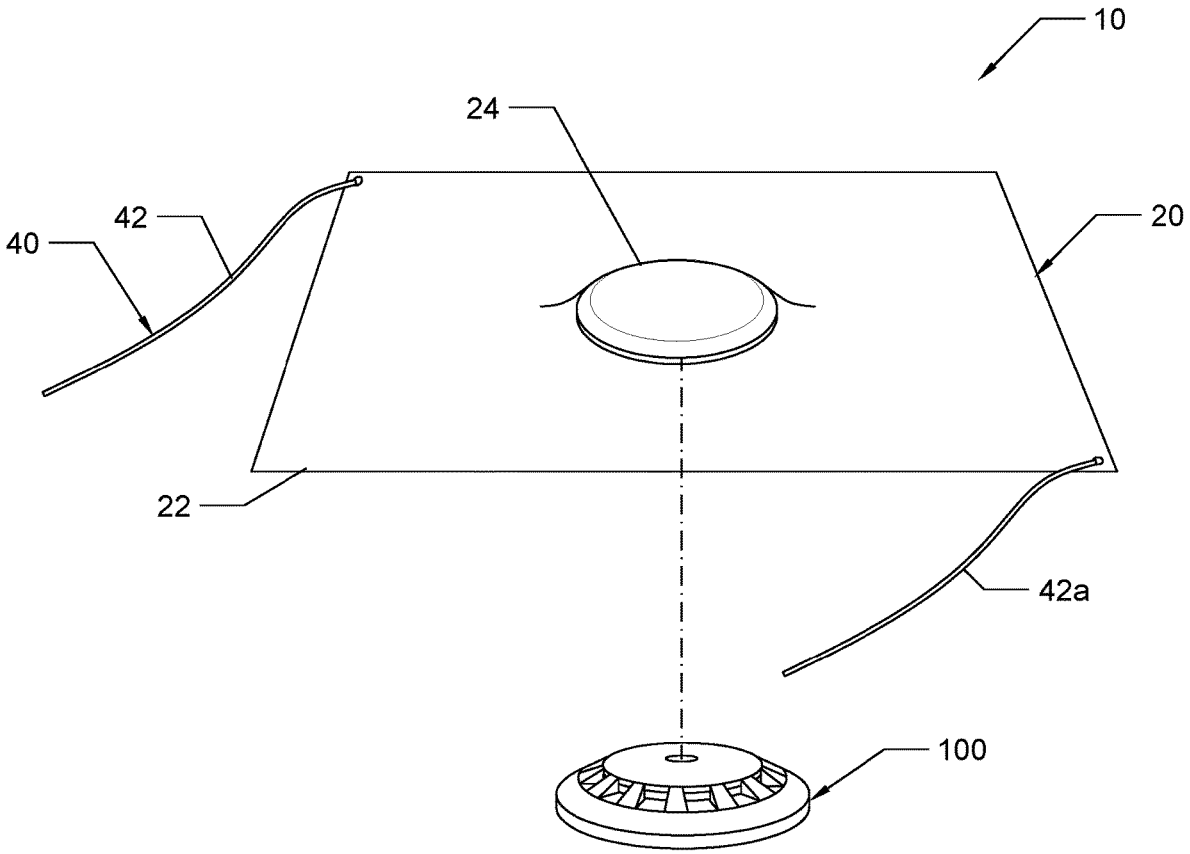

FIG. 4 is a representation of an exploded view between the present invention 10, wherein the bump 24 conforms with the shape of the swimming pool main drain cover 100 to be placed onto thereof.

V. DETAILED DESCRIPTION OF THE EMBODIMENTS OF THE INVENTION

Referring now to the drawings, where the present invention is generally referred to with numeral 10, it can be observed that it basically includes a cover assembly 20 and a wires assembly 40. It should be understood there are modifications and variations of the invention that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

Cover assembly 20 includes a cover 22 and a bump 24. In an exemplary embodiment, the cover 22 may be a sheet of plastic with a bigger area than a pool cover drain well known in the art. Nonetheless, it should be considered that the cover 22 may be made of vinyl, silicone, or any other suitable material well known in the art. In a suitable embodiment, the cover 22 may have a flat surface when placed onto the bottom side of the pool may be parallel to the plane thereof, thereby creating a seal therebetween, preventing any insect, worm or the like reaching the pool cover drain. As best depicted in FIG. 1.

Referring to FIG. 3, the bump 24 may be integrally formed in a center portion of the cover 22, wherein the bump 22 may be a bubble-shaped portion that conforms with the shape of the pool drain cover. As FIG. 2 illustrates. In a preferred embodiment, the portion of the pool drain cover that extends past the bottom side of the pool may fit into the volume formed by the bubble-shaped portion of the bump 24. As FIG. 4 shows. It should be considered that the bump 24 may have a suitable diameter where the pool drain cover in its various embodiments may fit into the bump 24.

Wires assembly 40 includes a wire 42. In an exemplary embodiment, the rope 42 may be attached at a top surface of the cover 22, wherein the rope 42 may include a plurality of ropes placed oppositely with respect to the rope 42. As best depicted in FIG. 2. In a suitable embodiment, the rope may be made of a polypropylene material, a synthetic material, a nylon material, or any other suitable material known in the art that may support long periods of time underwater without damaging. In a preferred embodiment, the rope 42 may have a suitable length to be handled by a user when the cover assembly 20 is placed inside the pool and the user is outside the pool, thereby the user may be able to move around the cover 22 until reach a predetermined position over the pool drain cover. It should be considered that the rope 42 may include a plurality of ropes 42*a* placed at the same top surface of the cover 22. As FIG. 2 represents.

Referring to the figures and more particularly to FIG. 1, the cover assembly is configured to be coupled over the pool drain cover 22, wherein the cover 22 may sink into the water and be handled by means of the wires assembly 40 from outside, thereby the cover over the pool drain cover creates a seal therebetween, preventing from collecting worms into the pool man drain system, and the cover 22 may be removed by pulling the rope 42 when the user may consider appropriate.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A pool drain cover, comprising:

a cover assembly including a cover and a bump, said cover is a flat sheet of plastic configured to be placed underwater, wherein said cover may be placed onto a bottom side of a pool, said bump is integrally formed on a central portion of said cover, wherein said bump is configured to be placed over a pool drain cover, embodied as a grate; and a wires assembly having ropes, wherein said ropes are attached to said cover, wherein said ropes are water-resistant, thereby said ropes are configured to be underwater without damaging.

2. The pool drain cover of claim 1, wherein said cover has parallel flat bottom surface with respect to said bottom side of said pool, creating a seal therebetween.

3. The pool drain cover of claim 1, wherein said cover has a bigger area than said grate.

4. The pool drain cover of claim 1, wherein said bump is a bubble-shaped portion of said cover.

5. The pool drain cover of claim 4, wherein said bubbled-shaped portion has a volume where said grate fits into.

6. The pool drain cover of claim 1, wherein said ropes are attached at a top surface of the corners of said cover.

7. The pool drain cover of claim 1, wherein said ropes are configured to be handled by a user, thereby said ropes have a length that extends over the pool until reaching an exterior side of said pool.

8. The pool drain cover of claim 1, wherein said cover is positioned by means of said ropes until placed over said grate.

9. A pool drain cover, comprising:

a cover assembly including a cover and a bump, said cover is a flat sheet of plastic configured to be placed underwater, wherein said cover may be placed onto a bottom side of a pool, wherein said cover has parallel flat bottom surface with respect to said bottom side of said pool, creating a seal therebetween, said bump is integrally formed on a central portion of said cover wherein, said bump is a bubble-shaped portion of said cover, wherein said bump is configured to be placed over a grate, said cover has a bigger area than said grate; and a wires assembly having ropes, wherein said ropes are water-resistant, thereby said ropes are configured to be underwater without damaging, wherein said ropes are attached at a top surface of the corners of said cover.

10. A pool drain cover, consisting of:

a cover assembly including a cover and a bump, said cover is a flat sheet of plastic configured to be placed underwater, wherein said cover may be placed onto a bottom side of a pool, wherein said cover has parallel flat bottom surface with respect to said bottom side of said pool, creating a seal therebetween, said bump is integrally formed on a central portion of said cover wherein, said bump is a bubble-shaped portion of said cover, wherein said bump is placed over a grate, thereby said bubbled-shaped portion has a volume where said grate fit into, wherein said cover has a bigger area than said grate; and a wires assembly having ropes, wherein said ropes are water-resistant, thereby said ropes are configured to be underwater without damaging, said ropes are attached at a top surface of the corners of said cover, said ropes are configured to be handled by a user.

* * * * *